United States Patent [19]

Mori et al.

[11] Patent Number: 4,628,163

[45] Date of Patent: Dec. 9, 1986

[54] POWER SWITCH

[75] Inventors: Teijiro Mori; Yuichi Wada, both of Hyogo; Masahiro Kakizoe, Aichi; Shigeru Masuda, Aichi; Shizutaka Nishizako, Aichi, all of Japan

[73] Assignee: Mitsubishi Denki Kabushiki Kaisha, Japan

[21] Appl. No.: 767,293

[22] PCT Filed: Dec. 7, 1984

[86] PCT No.: PCT/JP84/00578

§ 371 Date: Aug. 7, 1985

§ 102(e) Date: Aug. 7, 1985

[87] PCT Pub. No.: WO85/02711

PCT Pub. Date: Jun. 20, 1985

[30] Foreign Application Priority Data

| | | | |
|---|---|---|---|
| Dec. 7, 1983 | [JP] | Japan | 58-231136 |
| Dec. 7, 1983 | [JP] | Japan | 58-231140 |
| Mar. 19, 1984 | [JP] | Japan | 59-53103 |
| Mar. 19, 1984 | [JP] | Japan | 59-53106 |

[51] Int. Cl.[4] ..... H01H 33/08

[52] U.S. Cl. ..... 200/144 R; 200/147 R

[58] Field of Search ..... 200/144 R, 147 R

[56] References Cited

U.S. PATENT DOCUMENTS 4,477,704 10/1984 Mori et al. ..... 200/144 R 4,560,847 12/1985 Mori ..... 200/147 R

*Primary Examiner*—Robert S. Macon

*Attorney, Agent, or Firm*—Sughrue, Mion, Zinn, Macpeak, and Seas

[57] ABSTRACT

A power switch includes a fixed contact member 8 having a fixed contact 8A, a movable contact member 6 having a movable contact 6A movable into and out of contact with the fixed contact 8A, a commutation electrode 15 spaced from the movable contact member 6 for receiving an arc 12 generated between the fixed and movable contacts 8A, 6A when they are brought into contact with each other, and a plurality of extinguishing plates 13 for extinguishing the arc 12 transferred to the commutation electrode. The commutation electrode 15 has a first plate 15A extending parallel to the surface of the fixed contact 8A and spaced a prescribed distance from the fixed contact member 8, a second plate 15B extending parallel to the surface of the fixed contact 8A and positioned between the surface 6C of the movable contact member 6 to which no movable contact 6A is joined and the fixed contact member 8 at the time the movable contact 6A and the fixed contact 8A are separated, a third plate 15C connecting the first and second plates 15A, 15B to each other, a fourth plate 15D extending from the second plate 15B in the direction in which the movable contact 6A is separated, and a recess 15E defined in a portion confronting the movable contact 6A and extending from said second plate 15B to the third plate 15C and from the second plate 15B to the fourth plate 15D, whereby the arc can quickly be transferred to the commutation electrode 15.

6 Claims, 18 Drawing Figures

POWER SWITCH

TECHNICAL FIELD

The present invention relates to a power switch for switching on and off a current, and more particularly to an improvement in the circuit breaking performance of an electromagnetic contactor or a no-fuse circuit breaker, for example.

BACKGROUND ART

One conventional electromagnetic contactor is illustrated in FIG. 1. Designated at 1 is an attachment base molded of plastics, 2 a fixed laminated iron core composed of silicon steel plates, 3 a movable laminated iron core composed of silicon steel plates, 4 a control coil for imposing a driving force to attract the movable iron core 3 and the fixed iron core 2 against the force of a tripping spring (not shown), 5 a cross bar molded of plastics and having a rectangular window, the cross bar 5 supporting the mvoable iron core 3 on a lower end thereof, 6 a movable contact member inserted through the rectangular window of the cross bar 5, 6A a movable contact on one end of the movable contact member 6, 7 a presser spring for pressing the movable contact member 6, 8 a fixed contact member disposed in confronting relation to the movable contact member 6 and supporting on one end a fixed contact 8A, the movable contact 6A being movable into and out of contact with the fixed contact 8A, and 8B a terminal on the other end of the fixed contact member 8. When the contacts 6A, 8A are in contact with each other, a current flows from the fixed contact member 8 to the movable contact member 6. Denoted at 9 is a terminal screw for connecting the body of the electromagnetic contactor to an external circuit, 10 a base to which the fixed contact 8 is attached, 11 an arc cover disposed in covering relation to the electromagnetic contactor, 12 an arc generated between the fixed contact 8A and the movable contact 6A, and 13 a plurality of parallel metal extinguishing plates of a magnetic material which lie parallel to the surface of the fixed contact member 8 to which the fixed contact 8A is joined. The arrangement of FIG. 1 is symmetrical, and only a righthand portion thereof is shown in cross section.

When the control coil 4 is de-energized in the electromagnetic contactor thus constructed, the movable iron core 3 is separated from the fixed iron core 2 by a tripping mechanism (not shown), and the cross bar 5 is positioned as shown in FIG. 1. The fixed contact 8A and the movable contact 6A are separated from each other while an electric current is flowing therethrough to produce the arc 12 between the contacts 8A, 6A as shown in FIGS. 1 and 3. The arc 12 is attracted to the magnetic metal extinguishing plates 13, and moved successively through positions 12A, 12B as shown in FIG. 2. The arc 12 is finally extinguished between the metal extinguishing plates 13 to thereby cut off the current.

The conventional power switch (electromagnetic contactor) operates in the foregoing manner. When the arc is extinguished, only those of the parallel metal extinguishing plates 13 which are positioned between the movable contact member 6 and the fixed contact member 8 are involved, but not all of the metal extinguishing plates 13 are utilized. Therefore, the circuit breaking performance is poor, and the contacts tend to wear at a high rate.

DISCLOSURE OF THE INVENTION

The present invention has been made in an effort to eliminate the aforesaid shortcoming. It is an object of the present invention to provide a power switch having good circuit breaking performance and a movable contact subject to a reduced wearing rate, the power switch including a commutation electrode having a first plate with metal extinguishing plates interposed between the first plate and a fixed contact member, a second plate extending parallel to the surface of the fixed contact and positioned between the reverse surface of a movable contact member (to which no movable contact is joined) and the fixed contact member at the time the movable contact and the fixed contact are separated, a third plate connecting the first and second plates to each other, and a fourth plate extending from the second plate in the direction in which the movable contact is separated, the commutation electrode having a recess defined in a portion confronting the movable contact and extending from the second plate to the third plate and from the second plate to the fourth plate.

BRIEF DESCRIPTION OF THE DRAWINGS

FIG. 14(*a*) being a plan view and FIG. 14(*b*) being a side elevational view;

BEST MODE FOR CARRYING OUT THE INVENTION

Figure 4:
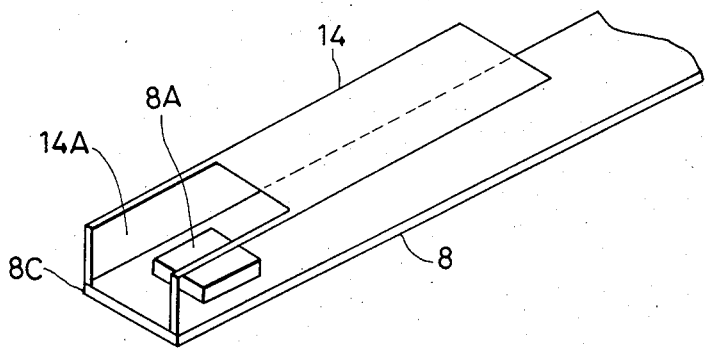
FIG. 4 is a perspective view of an arc runner employed in the power switch of FIG. 3.
Figure 5:
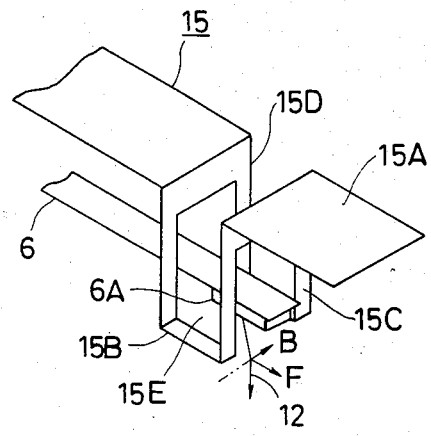
FIG. 5 is a perspective view of a commutation electrode of an embodiment of the invention.
Figure 6:
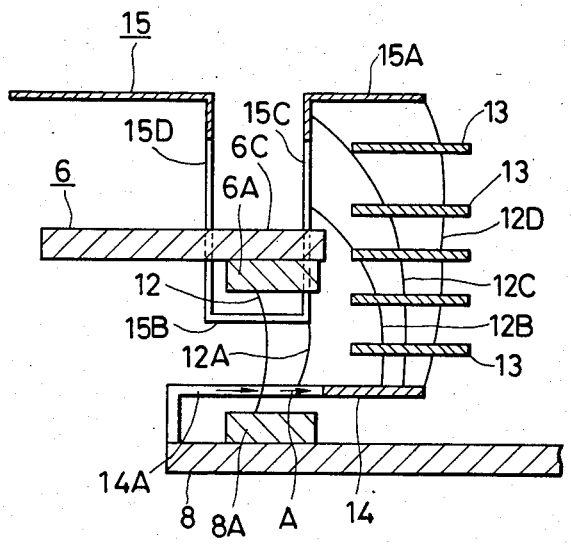
FIG. 6 is a view explanatory of operation of the embodiment of the invention.

An electromagnetic contactor having a fixed contact member and arc runner shown in FIG. 4 will first be described as an embodiment of the present invention. As Designated in FIGS. 3 through 6 at 11 is an arc cover having a number of holes 11A, 14 an arc runner electrically connected to a fixed contact member 8 at a fixed contact end 8C thereof, and 14*a* a recess defined in the arc runner 14 in confronting relation to the fixed contact 8A. FIG. 4 shows a commutation electrode 15 having a first plate 15A, a second plate 15B, a third plate 15C, a fourth plate 15D, and a recess 15E defined in a portion confronting a movable contact 6A. FIG. 5 shows a righthand half of the commutation electrode 15. The lefthand half of the commutation electrode 15 is identically constructed. As shwon in FIG. 6, the first plate 15A extends parallel to the surface of the fixed contact 8A with metal extinguishing plates 13 interposed between the first plate 15A and the fixed contact member 8. The second plate 15*b* extends parallel to the surface of the fixed contact 8A and positioned between the reverse surface of a movable contact member 6 (to which the movable contact is not joined) and the arc runner 14 when the fixed contact 8A and the movable contact 6A are separated from each other. The arc runner 14 extends parallel to the surface of the fixed contact 8A and is positioned between the fixed contact member 8 and the metal extinguishing plates 13. Denoted at 16 is a porous metal plate.

As is conventional, when the contacts 6A, 8A in the electromagnetic contactor are separated while an electric current is flowing therethrough, an arc 12 is produced between the contacts 6A, 8A and attracted to the metal extinguising plates 13 of a magnetic material. Since the arc runner 14 lies closer than the surface of the fixed contact member 8 to the movable contact 6A, the leg of the arc 12 on the fixed contact 8A is easily transferred onto the arc runner 14. Where the commutation electrode 14 is made of a magnetic material, a strong magnetic field is generated as indicated by the arrow B by a current flowing through the movable contact member 6 to impose a force F on the arc 12. The leg of the arc 12 on the movable contact 6A is therefore easily transferred onto the commutation electrode 15, and the arc 12 is moved to a position 12A shown in FIG. 6. When the arc reaches the position 12A, a current flows through the arc runner in the direction of the arrows A to drive the arc toward the metal extinguishing plates 13. At the same time, the arc 12A is moved due to the magnetic field produced by the current flowing through the arc runner 14 and also due to the current flowing through the communication electrode 15. The arc 12 A is therefore transferred through positions 12B, 12C to a position 12D. The arc 12D is extinguished between the first plate 15A and the arc runner 14, whereupon the current is shut off.

Since the leg of the arc 12 on the movable contact 6A is quickly transferred onto the commutation electrode 15, the wear on the movable contact 6A is reduced. Inasmuch as hte movable contact member 6 extends through the commutation electrode 15, it is not necessary to increase the distance by which the movable contact member 6 and the metal extinguishinig plates 13 are spaced from each other.

Since the arc 12D is extinguished between the first plate 15A and the arc runner 14, all of the metal extinguishing plates 13 are involved in extinguishing the arc. Therefore, the circuit breaking performance is excellent. As the arc is extinguished at the flat portions of the metal extinguishing plates 13, rather than on side edges thereof, an electric field concentration is less liable to take place at the arc leg. The thermal conduction is therefore improved and the circuit breaking performance is increased.

While the arc runner 14 is employed in the above embodiment, it may be dispensed with for improved circuit breaking performance and reduced wear on the movable contact.

Figure 7:
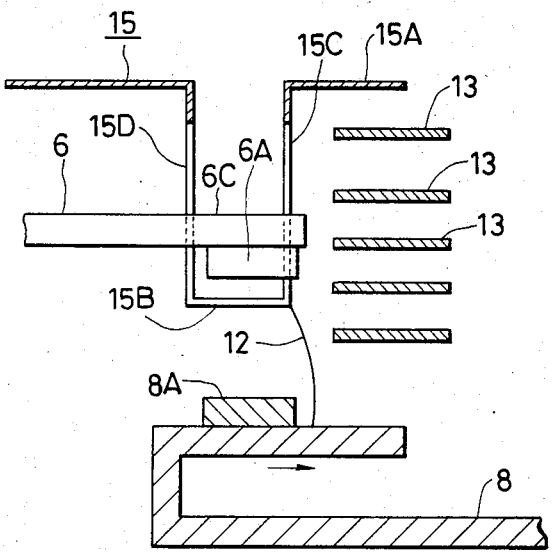
FIG. 7 is a side elevational view of another embodiment of the invention.

The present invention can be applied to a power switch having a fixed contact member 8 having a cross-sectional shape as shown in FIG. 7. The leg of the arc 12 is transferred from the fixed contact 8A to the fixed contact 8 under the magnetic field generated by a current (indicated by the arrow) flowing through the fixed contact member 8. As a consequence, the wear on the fixed contact 8A is reduced, the arcing time is shortened, and the circuit breaking performance is further improved.

Figure 8:
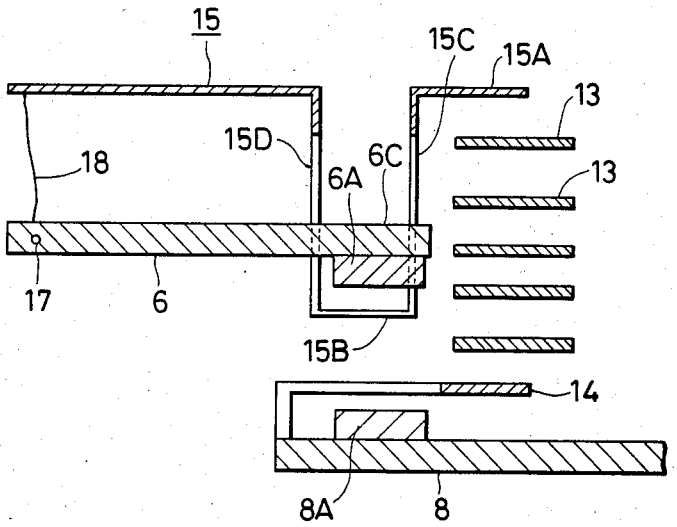
FIG. 8 is a side elevational view of still another embodiment of the invention.

As another embodiment, the invention can be appleid to a power switch such as a no-fuse circuit breaker as illustrated in FIG. 8 for the same advantages. Designated at 17 is a shaft about which the movable contact member is rotatable, and 18 a stranded wire by which the commutation electrode 15 and the movable contact member 6 are electrically connected to each other. The reference numeral 14 indicats an arc runner identical to that of FIG. 3.

Figure 9:
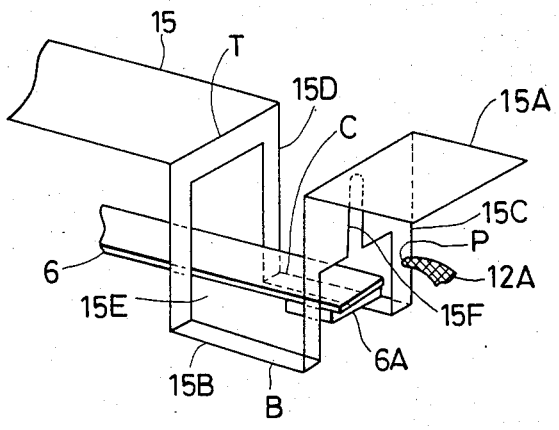
FIG. 9 is an enlarged fragmentary perspective view of a commutation electrode and a movable contact member according to a still further embodiment of the invention.

When a high-tension power switch is to be manufactured, it is necessary to increase the number of metal extinguishing plates 13. Since the excellent circuit breaking performance can be obtained by arranging the metal extinguishing plates 13 parallel to the surface of the fixed contact 8A, a high-tension power switch can be achieved without having to increase the area of installation of the power switch. FIG. 9 shows still another embodiment of the present invention. According to this embodiment, there is provided a power switch capable of quickly driving an arc generated between movable and fixed contacts by forming a slit extending from a recess in a commutation electrode to a first plate thereof, the slit having a width smaller than that of the recess.

The embodiment of FIG. 9 will be described below. FIG. 9 is a perspective view of a commutation electrode according to this embodiment. Designated at 15F is a slit extending from a recess 15E to a first plate 15A and having a width smaller than that of the recess 15E. The electromagnetic contactor according to this embodiment is identical to that shown in FIG. 3, except for the commutation electrode 15.

Circuit breaking operation will now be described. The operation of the electromagnetic contactor of this embodiment is the same as that of the embodiment shown in FIG. 3, except for the following operation. The different operation will be described with reference to FIG. 9. When one leg of an arc 12A is produced at a point P, the length of a path TBP is longer than the length of a path TCP because of the slit 15F. As a result, there is a large difference between the resistance RTBP of the path TBP and the resistance RTCP of the path TCP, and also there is a large difference between the current IB flowing through the path TBP and the current IC flowing through the path TCP. Therefore, the arc 12A is subject to a larger upward driving force and driven upwardly at a high speed. Since the arc 12A is thus prevented from being stuck to the point P, the arcing time can be shortened and the arc energy can be lowered. Consequently, the circuit breaking performance can be increased.

Figure 10:
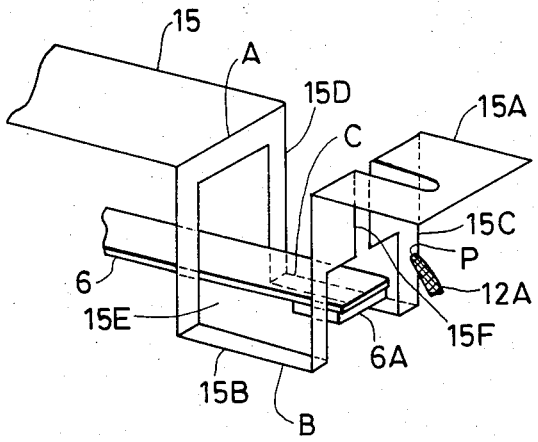
FIG. 10 is an enlarged fragmentary perspective view of a commutation electrode and a movable contact member according to another embodiment of the invention.

FIG. 10 is a perspective view of a commutation electrode according to a still further embodiment of the present invention. In this embodiment, a slit 15F extends not only in the third plate 15C but also in a portion of the first plate 15A. Therefore, the difference between the path TBP and the path TCP is larger than that in FIG. 9. The arc 12A can be driven at a higher speed than the speed with the embodiment of FIG. 9, and the circuit breaking performance is further improved.

It may be assumed that as the slit 15F is wider, the interference between the paths is smaller. However, if the slit were too wide, the widths of the paths would be reduced and their resistances would be increased. Since the mechanical strength would also be lowered, the slit 15F should be narrower than the recess 15E.

Figure 11:
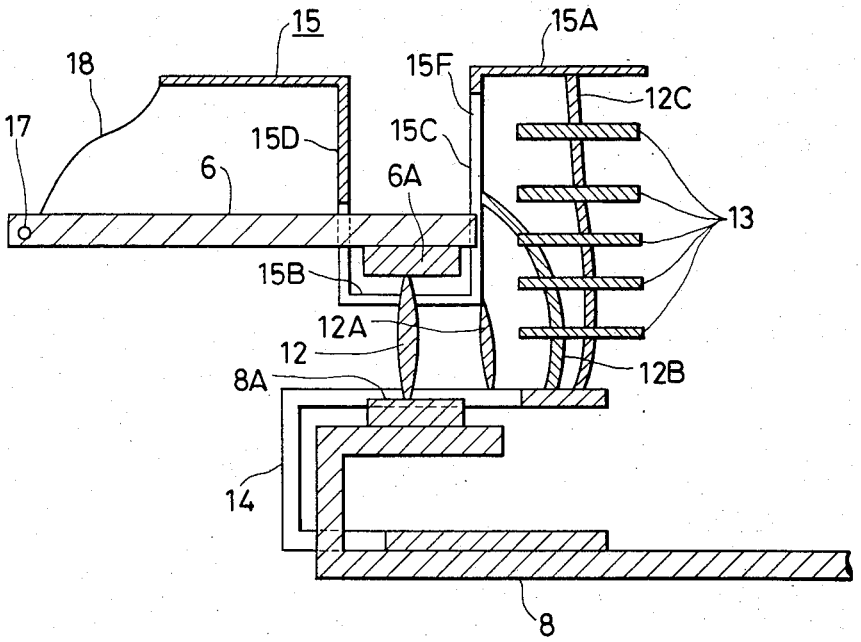
FIG. 11 is a view explanating an arc extinguishing process in still another embodiment of the invention.

In the above embodiments, the present invention is applied to an electromagnetic contactor. However, the invention may be applied to a no-fuse circuit breaker. FIG. 11 illustrates an arc extinguishing process in such a no-fuse circuit breaker to which the invention is applied. Denoted at 17 is a shaft about which a movable contact member 6 is rotatable, and 18 a flexible stranded wire connecting a commutation electrode 15 to the movable contact member 6. The movable contact member 6 is rotatable about the shaft 17 for opening and closing the contacts 6A, 8A. Although not shown, the no-fuse circuit breaker is associated with an overcurrent detector and a control mechanism.

Operation will now be described. When an overcurrent flows, it is detected by the overcurrent detector which causes the control mechanism to separate the movable contact 6A from the fixed contact 8A, producing an arc 12. The arc 12 is attracted to metal extinguishing plates 13 and driven by the magnetic field produced by a current flowing through the movable contact member 6 and the fixed contact member 8 so that the arc is moved through 12A, 12B, and 12C and then entinguished by the metal extinguishing plates 2, a process which is the same as that employed in the foregoing embodiments of the invention. In FIG. 11, the slit 15F is defined in the third plate 15C of the commutation plate 15, so that the arc 12 can be driven quickly for increased circuit breaking performance for hte same reasons as those in the embodiment of FIG. 9. The slit 15F may extend partly into the first plate 15A, instead of being defined only in the third plate 15C, for attaining the same advantages.

In each of the above embodiments, the recess 15E extends from the fourth plate 15D tghrough the second plate 15B to the third plate 15C. However, the recess 15E may be defined only in the fourth plate 15D and the second plate 15B for the same advantages as those in the foregoing embodiments.

As described above, the slit extending from the recess in the commutation electrode toward the first plate and narrower than the recess, as shown in FIGS. 9 through 11, is effective in quickly driving an arc produced between the contacts, with the result that the circuit breaking performance can be increased. According to another embodiment illustrated in FIG. 12, the third through first plates of the commutation electrode 15 are divided into lateral parts by a slit extending from the third plate to the first plate for quickly driving an arc for improved circuit breaking performance.

Figure 3:
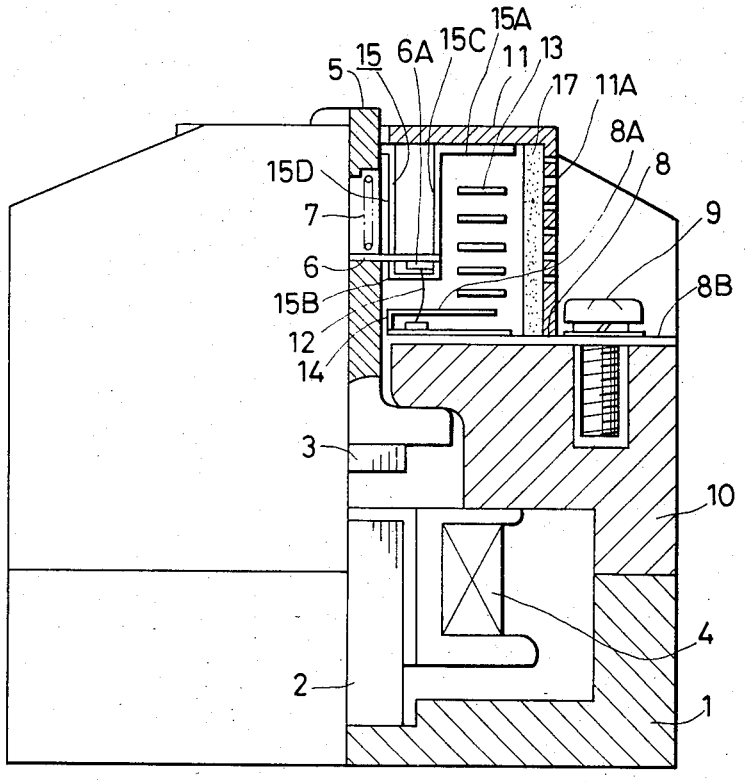
FIG. 3 is a righthand sectional side elevational view of a power switch according to an embodiment of the present invention.
Figure 12:
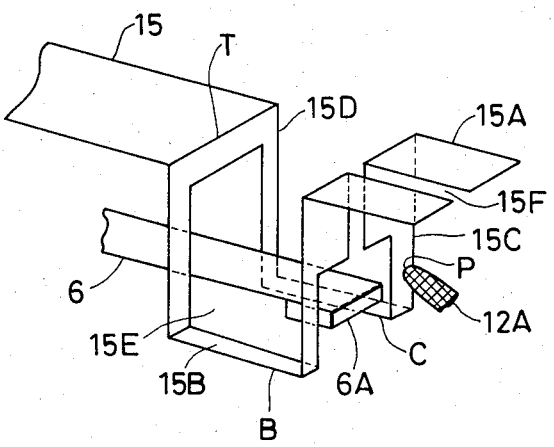
FIG. 12 is an enlarged fragmentary perspective view of a commutation electrode and a movable contact member according to a still further embodiment of the invention.

The embodiment of FIG. 12 is the same as the electromagnetic contactor shown in FIG. 3 except for the commutation electrode 15. Therefore, FIG. 12 fragmentarily shows a central portion including the commutation electrode 15. The commutation electrode 15 has a slit 15F extending from the third plate 15C to the first plate to divide the third plate 15C through the first plate 15A into lateral parts. Operation of the embodiment fragmentarily shown in FIG. 12 is the same as that of the electromagnetic contactor shown in FIG. 3, except for the following operation: When one leg of an arc 12A is produced at the point P in FIG. 12, the arc is not influenced by a current IB flowing through a path TBP, but is largely affected by a current IC flowing through a path TCP since the commutation plate 15 is divided by the slit 15F up to the third plate 15A. Therefore, the arc 12A is forcibly driven upwardly under an increased upward driving force against being stuck at the point P. The arcing time is shortened and the arc energy is reduced. Since the arc energy is reduced, the circuit breaking performance can be increased.

Figure 13:
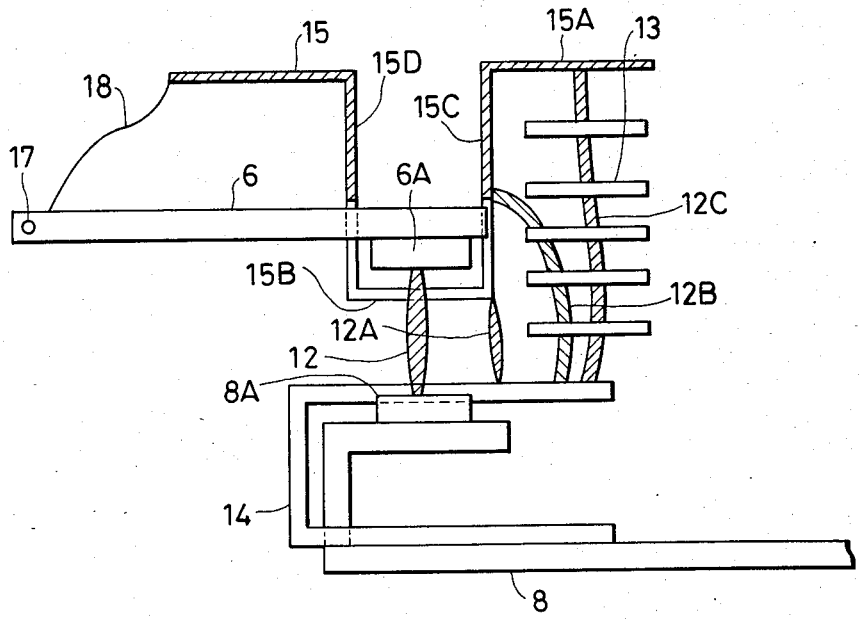
FIG. 13 is a partly sectional side elevational view of an embodiment in which the commutation electrode and the movable contact member of FIG. 12 are incorporated in a no-fuse circuit breaker.

The present, invention can be applied to a no-fuse circuit breaker. A no-fuse circuit breaker to which the invention is applied is fragmentarily shown in FIG. 13. In the illustrated embodiment, a movable contact member 6 is rotatable about a shaft 17 for opening and closing the contacts. A commutation electrode 15 is connected to the movable contact member 6 through a flexible stranded wire 18. Although not shown, the no-fuse circuit breaker is associated with an overcurrent detector and a control mechanism. When an overcurrent flows, it is detected by the overcurrent detector which causes the control mechanism to separate the movable contact 6A from the fixed contact 8A, producing an arc 12A which is extinguished in a process which is the same as that employed in the embodiment of FIG. 6. In FIG. 13, the third plate 15C through the first plate 15A of the commutation electrode 15 are divided into lateral parts by a slit 15F extending from the third plate 15C to the first plate 15A, so that the circuit breaking performance can be improved for the same reasons as those in the embodiment of FIG. 12.

Because the third plate 15C through the first plate 15A of the commutation electrode 15 are divided into lateral parts by the slit 15F as shown in FIGS. 12 and 13, the circuit breaking performance can be improved.

Figure 1:
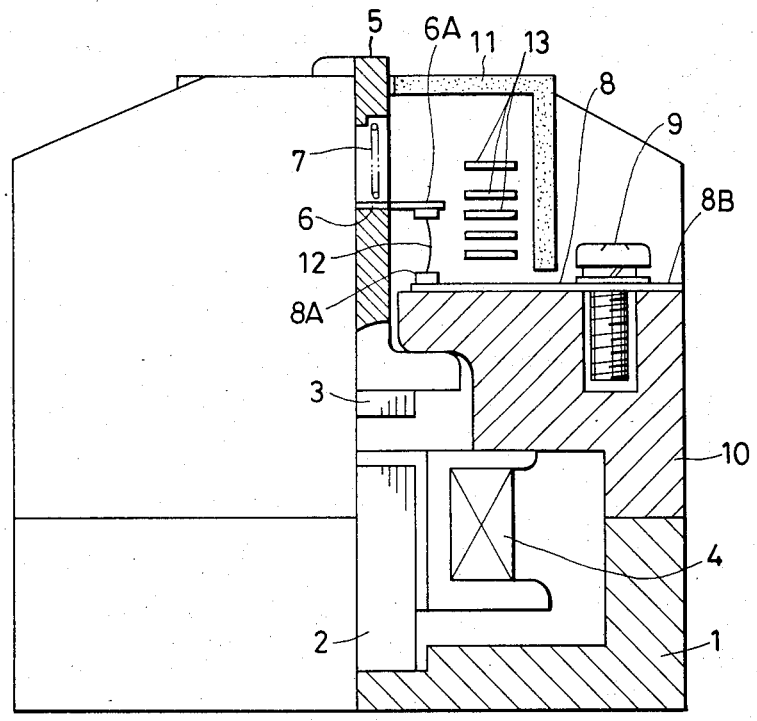
FIG. 1 is a righthand sectional side elevational view of a conventional power switch.
Figure 2:
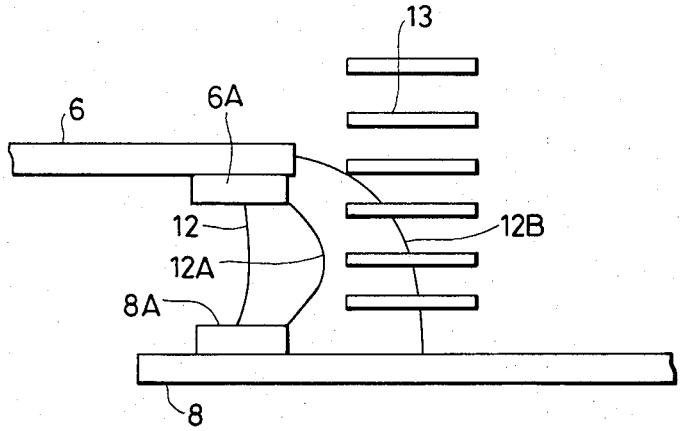
FIG. 2 is an enlarged fragmentary side elevational view of FIG. 1.
Figure 14A:
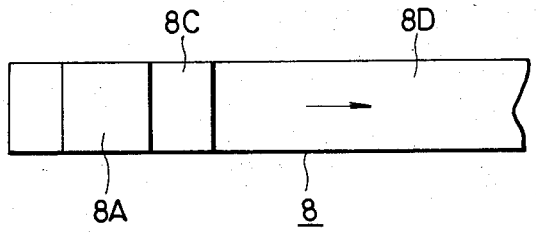
FIG. 14 shows a modification of the fixed contact member of the invention.
Figure 14B:
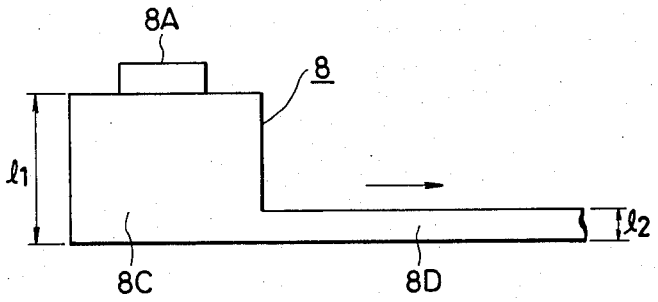
Figure 15A:
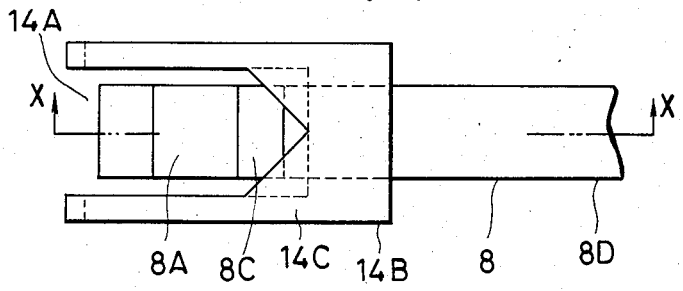
FIG. 15 illustrates the combination of the fixed contact member of FIG. 14 and a modified arc runner, FIG. 15(*a*) being a plan view and FIG. 15(*b*) being a cross-sectional view taken along line X—X of FIG. 15(*a*)
Figure 15B:
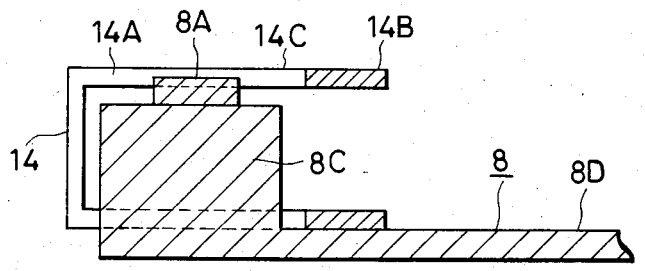
Figure 16:
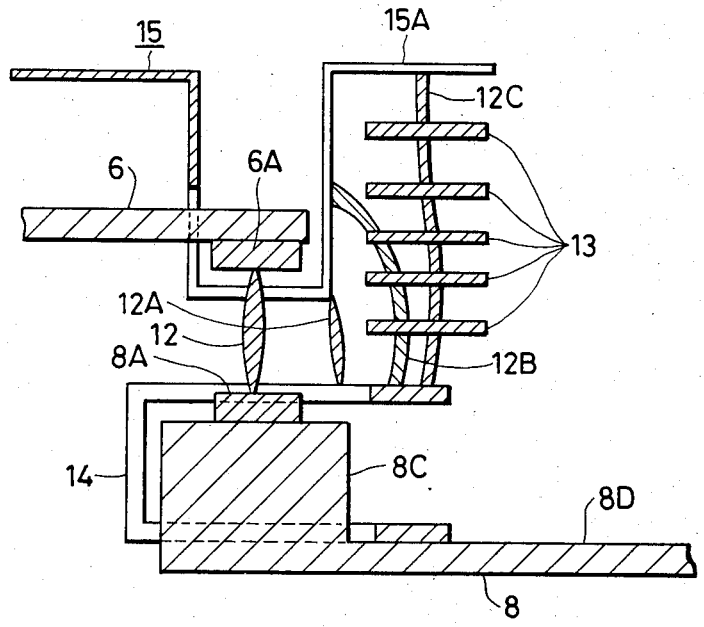
FIG. 16 is a fragmentary vertical cross-sectional view of an electromagnetic contactor incorporating the fixec contact member and the arc runner shown in FIG. 15.

Embodiments shown in FIGS. 14 through 16 are designed to prevent the contacting area between the movable and fixed contact members from being abnormally heated. Where the fixed contact member 8 is of a C-shaped cross section as shown in FIG. 7 for increasing magnetic driving forces for driving the arc 12, the heat produced in the contact area between the movable contact 6A and the fixed contact 8A when a load current is continuously passed cannot easily be radiated toward the terminal 8B (FIG. 1), and hence the current passing capability of the electromagnetic contactor is lowered. When an overcurrent is passed for a short period of time, the fixed contact member 8 and the movable contact member 6 is subject to an abnormal temperature rise, causing the cross bar 5 molded as of plastics to damage the base 10.

FIGS. 14 through 16 show modifications of the fixed ccntact and the arc runner. The fixed contact member has a contacting portion and a fixed portion integrally formed with the contact joint area and extending in the direction in which an arc runs. The length of the contacting portion in the direction in which the contacts are brought into and out of contact with each other is larger than the length of the fixed portion in the same direction. The arc runner has a recess through which the movable contact can pass and a free end, and also has an arc running portion positioned closer to the movable contact than the surface on which the fixed contact is joined to the fixed contact member. With the fixed contact member and the arc runner, the power switch can prevent the contacts and the contact members from being heated to high temperature due to the heat produced where the contacts are brought into contact at the time a load current is passed.

The above modifications will hereinafter be described. FIGS. 14(*a*) and 14(*b*) are plan and side elevational views of a modified fixed contact member 8 according to the present invention. The fixed contact member 8 includes a contacting portion 8C ad a fixed portion 3D integrally formed with the contacting portion 8C and extending in the direction in which the arc runs. The length l1 of the contacting portion 8C in the direction in which the contacts are brought into and out of contact with each other is larger than the length l2 of the fixed portion 8D in the same direction. In the illustrated embodiment, the contacting portion 8C is in the form of a rectangular parallelepiped.

FIGS. 15(*a*) and 15(*b*) illustrate a modified combination of an arc runner 14 and a fixed contact member 8. FIG. 15(*a*) is a plan view, and FIG. 15(*b*) is a cross-sectional view taken along line X—X of FIG. 15(*a*). Designated at 14A is a recess through which the movable contact can pass when it is brought into and out of contact with the fixed contact 8A, 14B a free end, and 14C an arc running portion positioned closer to the movable contact (disposed above in FIG. 15(*b*)) than the surface on which the fixed contact 8A is joined to the fixed contact member 8. An arc runner 14 having these portions 14A, 14B, 14C is joined as by a screw or brazing to the fixed contact member 8 such that the direction of a current flowing in the arc runnng portion 14C after the leg of an arc on the fixed contact 8A has been transferred to the arc running portion 14C will be aligned with the direction of a current flowing through the movable contact member.

The fixed contact member 8 and the arc runner 14 according to the above modification are incorporated in the electromagnetic contactor as shown in FIG. 3, and used as fragmentarily shown in FIG. 16 at an enlarged scale.

Operation will now be described.

When the coil 4 as shown in FIG. 3 is energized, the movable iron core 3 is attracted to the fixed iron core 2 to bring the movable contact 6A into contact with the fixed contact 8A, and a current flows from the fixed contact member 8 through the contacts 6A, 8A to the movable contact member 6. At this time, the heat generated where the contacts 6A, 8A contact each other is easily transmitted toward the terminal (as indicated by the arrow in FIG. 14) since the fixed conctact member 8 is shaped as shown in FIG. 14, but not cross-sectionally C-shaped. When an overcurrent is passed for a short period of time, the contacting portion 8C in the form of a rectangular parallelepiped can store a certain amount of heat for thereby preventing the cross bar 5 and the base 10 from being damaged by an abnormal temperature rise of the contact members 6, 8.

When the coil 4 is de-energized, the movable iron core 3 is separated from the fixed iron core 2 by the non-illustrated tripping spring. The movable contact 6A is therefore brought out of contact with the fixed conatct 8A, whereupon an arc 12 is generated between the contacts 6A, 8A as shown in FIG. 16. The arc 12 is attracted to the metal extinguishing plates 13 and transferred to a position 12A between the commutation electrode 15 and the arc runner 14. The arc 12A is then attracted by the metal extinguishing plates 13 and driven by the magnetic field generated by currents flowing through the commutation electrode 15 and the arc runner 14. The arc 12A is therefore moved through a position 12B to a position 12C while being driven by the first plate 14A and the free end 14B of the arc runner 14, and then extinguished by the metal extinguishing plates 13. As with the embodiment of FIG. 3, an arced gas produced while the arc is being generated is cooled as it passes through the pores in the porous metal plate 16, and then discharged out of the holes 11A in the arc cover 11. Since the arc runner 14 is provided as shown in FIGS. 14 and 15, the circuit breaking performance can be improved even without using a fixed contact member 8 of a C-shaped in cross section.

According to the above modifications, as described above, the contacting portion 8C is in the form of a rectangular parallelepiped for preventing the contacts 6A, 8A and the contact members 6, 8 from being heated to high temperature due to the heat generated where the contacts 6A, 6B contact each other when a load current flows therethrough. As a result, the current passing capability can be increased. Inasmuch as the arc runner 14 shown in FIG. 15 is employed, the circuit breaking performance is not lowered.

While in the above modifications the contacting portion 8C is in the form of a rectangular parallelepiped, it may be cube-shaped for attaining the same advantages.

Although in the above modifications the present invention is applied to an electromagnetic contactor, the invention is also applicable to other power switches such as a no-fuse circuit breaker as shown in FIGS. 8, 11, and 13.

I claim:

1. A power switch comprising a fixed contact member 8, a fixed contact 8A joined to the fixed contact member 8, a movable contact member 6, a movable contact 6A joined to the movable contact member 6 and movable into and out of contact with said fixed contact 8A, a commutation electrode 15 having a first plate 15A extending parallel to the surface of said fixed contact 8A and spaced a prescribed distance from said fixed contact member 8, a second plate 15B extending parallel to the surface of said fixed contact 8A and positioned between the surface 6C of said movable contact member 6 to which no movable contact 6A is joined and said fixed contact member 8 at the time said movable contact 6A and said fixed contact 8A are separated, a third plate 15C connecting said first and second plates 15A, 15B to each other, a fourth plate 15D extending from said second plate 15B in the direction in which said movable contact 6A is separated, and a recess 15E defined in a portion confronting said movable contact 6A and extending from said second plate 15B to said third plate 15C and from said second plate 15B to said fourth plate 15D, and a plurality of metal extinguishing plates 13 disposed parallel to the surface of said fixed contact member 8 and between said fixed contact member 8 and said first plate 15A.

2. A power switch according to claim 1, including a plate-shaped arc runner 14 having one end electrically connected to said fixed contact member 8 at a fixed contact end 8C thereof, said arc runner 14 being disposed between said fixed contact member 8 and said metal extinguishing plates 13 and having a recessed portion 14A parallel to the surface of said fixed contact 8A and confronting said fixed contact 8A.

3. A power switch according to claim 1, wherein said commutation electrode 15 has a slit 15F defined therein and extending from said recess 15E toward said first plate 14A, said slit 14F having a width smaller than that of said recess 15E.

4. A power switch according to claim 1, wherein said commutation electrode 15 has a slit 15F defined therein in contiguous relation to said recess 15E and extending continuously from a lower end of said third plate 15C toward an end of said first plate, said third plate 15C and sair first plate 15A being divided by said slit 15F.

5. A power switch according to claim 1, wherein said fixed contact member 8 has a contacting portion 8C and a fixed portion 8D integrally formed with said contacting portion 8C and extending in the direction in which an arc runs, the length l1 of said contacting portion 8C in the direction in which said contacts 6A, 8A are brought into and out of contact with each other being larger than the length l2 of said fixed portion 8D in said last-mentioned direction, further including an arc runner 14A having a recess 14A through which said movable contact 6A can pass when it is brought into and out of contact with said fixed contact 8A, a free end 14B, and an arc running portion 14C positioned closer to said movable contact 6A than the surface on which said fixed contact 8A is joined to said fixed contact member 8.

6. A power switch according to claim 1, wherein said metal extinguishing plates 13 are made of a magnetic material.

* * * * *